US006080940A

United States Patent [19]

Rice

[11] Patent Number: 6,080,940

[45] Date of Patent: Jun. 27, 2000

[54] PUSH-BUTTON SWITCH SPRING

[75] Inventor: Roy A. Rice, Milwaukee, Wis.

[73] Assignee: Rockwell Technologies, LLC, Thousand Oaks, Calif.

[21] Appl. No.: 09/081,547

[22] Filed: May 19, 1998

[51] Int. Cl.[7] ..... H01H 3/12

[52] U.S. Cl. ..... 200/5 A; 200/341; 200/516

[58] Field of Search ..... 200/5 A, 341, 200/345, 516

[56] References Cited

U.S. PATENT DOCUMENTS 4,293,754 10/1981 Komaki ..... 200/341
4,311,893 1/1982 Tsuchiya et al. ..... 200/340
4,675,787 6/1987 Suwa ..... 261/404
5,578,802 11/1996 Palmowski ..... 200/5 A
5,747,757 5/1998 Van Zeeland et al. ..... 200/5 A

*Primary Examiner*—Renee Luebke
*Attorney, Agent, or Firm*—William R. Walbrun; John J. Horn; Keith M. Baxter

[57] ABSTRACT

The present invention provides a spring integrally formed in a face plate of a housing for use with printed circuit board mounted operators having a central portion and J-shaped extensions. Stresses incurred when the central portion of the spring is pressed are distributed along the length of the extensions thus reducing maximum stress concentration in the spring. Additionally, material surrounding the spring is only minimally deflected when a spring is deflected, adjacent operators are not inadvertently actuated.

15 Claims, 7 Drawing Sheets

FIG. 4
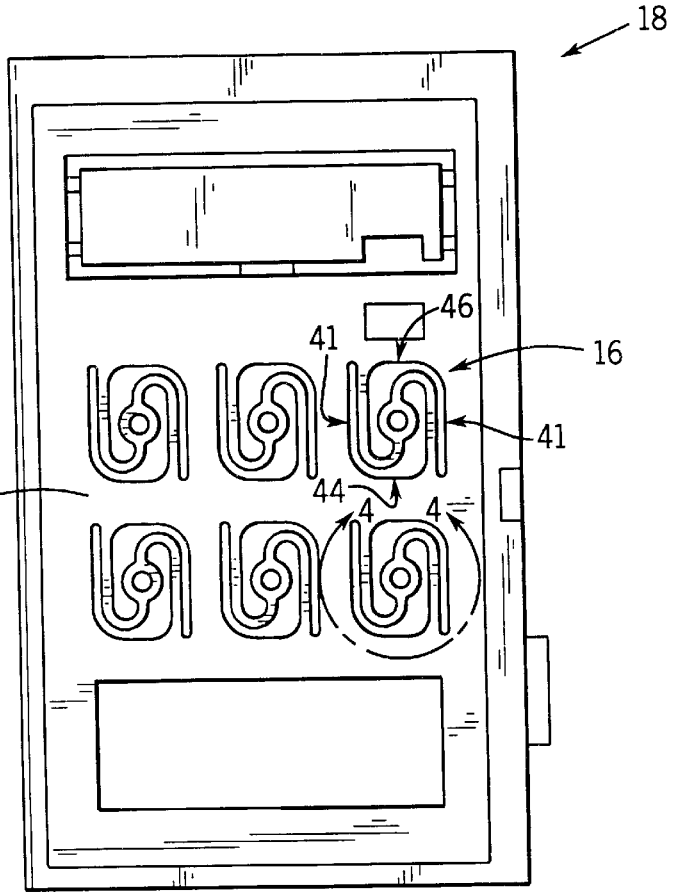
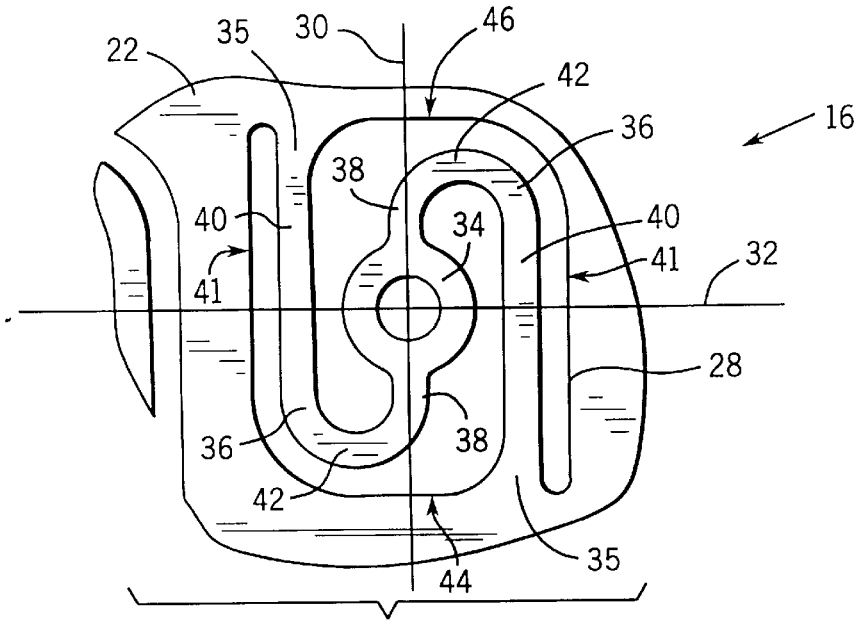
FIG. 5

PUSH-BUTTON SWITCH SPRING

CROSS REFERENCES TO RELATED APPLICATIONS

Not Applicable

STATEMENT REGARDING FEDERALLY SPONSORED RESEARCH

Not Applicable

BACKGROUND OF THE INVENTION

The field of invention is low profile push button switches for use with printed circuit boards and the like, more particularly a spring for use with such circuit board mounted push-button switches.

Printed circuit board (PCB) mounted "push button" switches are an inexpensive means of providing an operator interface on industrial control products. These switches are quite small, and have operators that are not designed to be pressed by human fingers. For this reason, an intermediate interface is used that provides a large target area and a spring biasing the interface outward. Preferably the spring must withstand in excess of one million operations to ensure proper operation for the useful life of the switches.

A known design for an intermediate interface provides a key cap retained in a housing disposed above an operator. A spring in the housing interposed between the operator and the key cap biases the key cap away from the operator. Each adjacent switch has an independent housing, key, and switch assembly, thus preventing the actuation of one switch from affecting the other switches. This solution has multiple parts that are expensive and difficult to assemble when multiple switches are adjacent to each other.

Another known solution, shown in FIG. 9, is to integrally form multiple plastic springs on a faceplate of a single housing. An overlay with printed key caps is adhesively mounted on the face plate identifying the location of each spring and operator disposed below. A key cap is depressed to actuate an operator disposed below the spring. One particular prior art solution has a housing face plate with a plurality of circular apertures. A spring disposed in each aperture has a central portion and a pair of semicircular extensions. The extensions are integrally formed part of the central portion and the face plate. This circular spring design can produce stress levels when a operator is actuated that reduces the spring useful life. Additionally, depressing a spring may cause the adjacent face plate material to deflect actuating adjacent operators.

BRIEF SUMMARY OF THE INVENTION

The present invention provides a spring having a finger target and J-shaped extensions that is integrally formed part of a face plate of a housing for use with printed circuit board mounted switches. Stresses incurred when the finger target of the spring is pressed are distributed along the length of the extensions reducing maximum stress concentrations in the spring. Thus, a general objective of the present invention of providing a spring with a long useful life is accomplished.

Another objective of the present invention is to provide a spring for use with printed circuit board mounted switches that does not actuate adjacent switches when pressed. Th present invention accomplishes this objective by causing only minimal deflection of the face plate surrounding the deflected spring.

The foregoing and other objects and advantages of the invention will appear from the following description. In the description, reference is made to the accompanying drawings which form a part hereof, and in which there is shown by way of illustration a preferred embodiment of the invention.

BRIEF DESCRIPTION OF THE DRAWINGS

FIG. 4 is a plan view of the spring assembly housing of FIG. 2;

FIG. 5 is a plan view of a spring shown in FIG. 4;

DETAILED DESCRIPTION OF THE PREFERRED EMBODIMENTS

Figure 1:
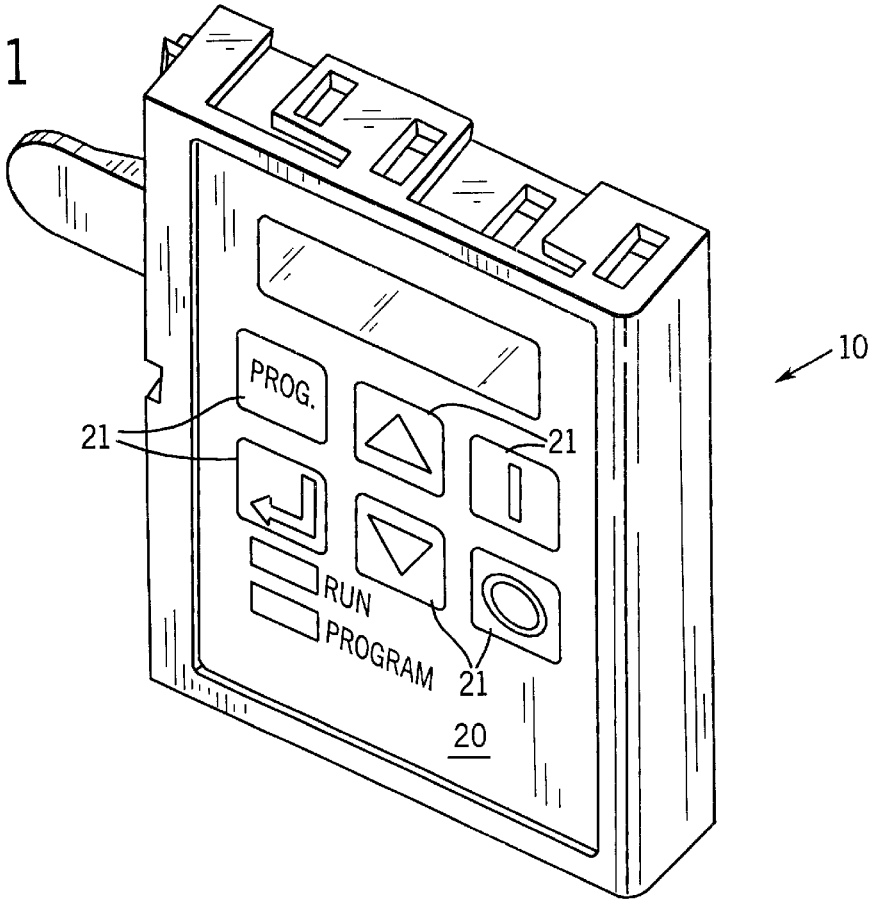
FIG. 1 is a perspective view of the outside of a switch panel incorporating the spring assembly and printed circuit board switch of the present invention.
Figure 2:
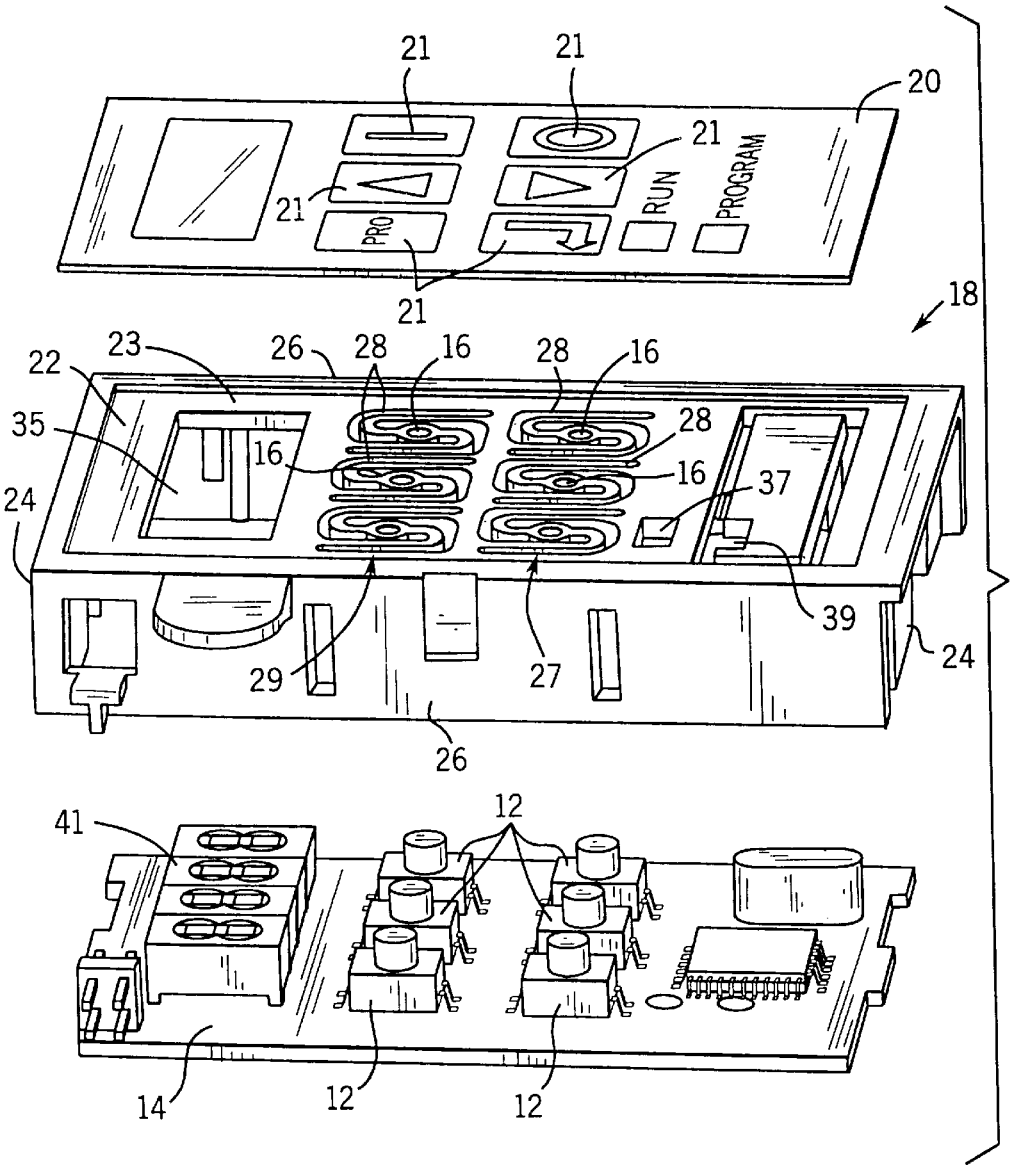
FIG. 2 is an exploded perspective view of the switch panel showing a printed overlay, a spring assembly housing and printed circuit board of FIG. 1.

Referring to FIGS. 1 and 2, a switch panel 10 for an industrial control product is composed of a plurality of push-button operators 12 mounted in close proximity to each other on a printed circuit board 14. A housing 18 having a face plate 22 with a plurality of generally rectangular apertures 28 is disposed above the printed circuit board 14. A spring 16 disposed in each aperture 28 above an operator 12 is integrally formed as part of the face plate 22. An overlay 20 adhesively mounted to the face plate 22 has printed key caps 21 identifying the location and function of each operator 12 disposed below. A user actuates an operator 12 by pressing a key cap 21 disposed above the operator 12 to be actuated. Each spring 16 is integrally formed part of the housing 18 and transfers the user action to the desired operator 12 without activating adjacent operators 12.

As shown in FIG. 2, the housing 18 has a face plate 22, a pair of opposing end walls 24, and a pair of opposing side walls 26. The housing 18 is coupled to the printed circuit board 14 by tabs formed in the housing end walls 24. Preferably, the housing 18 is made of a resilient material, such as a thermoplastic polymer or the like, using injection molding or other methods known in the art.

Figure 3:
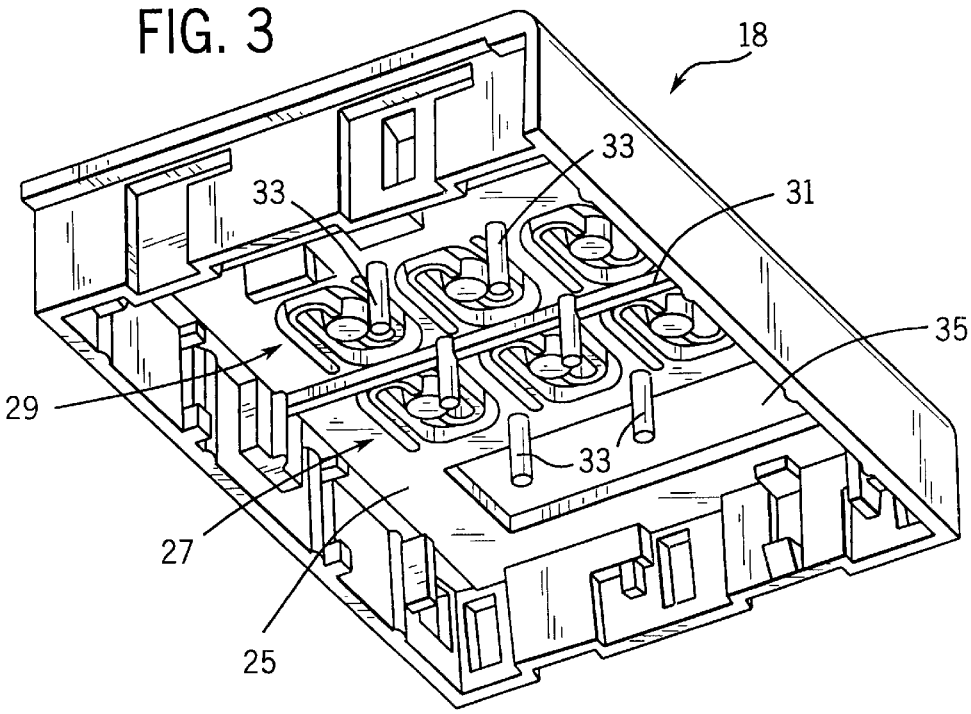
FIG. 3 is a perspective view of the lower surface of a spring assembly housing of FIG. 2.

Referring to FIGS. 2 and 3, the face plate 22 has an upper surface 23 and a lower surface 25. Two rows 27, 29 of three closely spaced apertures 28 are formed in the face plate 22. A rib 31 formed on the lower surface 25 of the face plate 22 is interposed between the two rows 27,29 of the apertures 28 and stiffens the face plate 22. Six legs 33 extend away from the lower surface of the face plate 22 and define the spacing between the face plate lower surface 25 and the printed circuit board 14. The legs 33 are spaced around the perimeter of the center aperture of each row of apertures 28. Other openings 35, 37, 39 formed in the face plate allow viewing a display 41 or indicator lights (not shown) mounted on the printed circuit board 14.

In the embodiment shown in FIG. 4, each aperture 28 defines an opening that is approximately 0.40 inches wide and 0.46 inches long. The apertures 28 are closely spaced being approximately 0.47 inches apart from the center of one aperture 28 to the center of the adjacent aperture 28 in the transverse direction and 0.55 inches apart center to center in the longitudinal direction. These dimensions allow the use of operators 12 that are 0.47 inches on center. Each aperture 28 has a pair of opposing sides 41 joined by opposing ends 44, 46, and defines an operator 12 position on the printed circuit board 14. The present invention allows close spacing of the operators, however, the operators and corresponding springs need not be closely spaced to practice the invention.

Referring to FIG. 5, each aperture 28 is bisected by both a major, longitudinal, axis 30 and a minor, transverse, axis 32. The axes 30, 32 intersect at the center of the aperture 28. A finger target 34 is centrally disposed in the aperture 28 at the intersection of the major and minor axes 30, 32. Preferably, the finger target is cylindrical having an axis perpendicular to a plane defined by the face plate 22. The operator axially displaces the finger target 34, which in turn comes into contact with the operator 12 mounted on the printed circuit board 14, thus actuating the operator 12.

A pair of J shaped extensions 36 integrally formed part of the finger target 34 and the face plate 22 hold the finger target 34 longitudinally and transversely within the aperture 28. Axial movement of the finger target 34 is restricted by the deflection limits of the extensions 36.

Each of the J shaped extensions 36 has a short leg 38, a long leg 40, and a curved portion 42. The short leg 38 of each extension 36 extends radially from the finger target 34 in opposite directions along the major axis 30 of the aperture 28. The long leg 40 of each extension 36 is generally parallel to the short leg 38 and extends into opposing aperture ends 44, 46 forming an integral part of the face plate 22.

Preferably, the curved portion 42 of the extensions 36 has an inside radius of approximately 0.050 inches and an outside radius of approximately 0.130 inches, thus allowing the extensions 36 having a generally constant width of approximately 0.039 inches to curve 180 degrees within the aperture dimensions to form the J-shape. The extensions 36 deflect when the finger target 34 is acted upon by the user to activate a operator 12.

The J shape of the extensions 36 uniquely distributes the stresses along its length when the central portion 34 is deflected. This distribution results in lower stress concentrations in the spring 16 than the prior art shown in FIG. 9 for the same deflection. This stress distribution results specifically in lower stress concentrations at the spring base 35, thus reducing the deflection of the face plate 22 and the effect of the spring deflection on adjacent operators 12.

Figure 6:
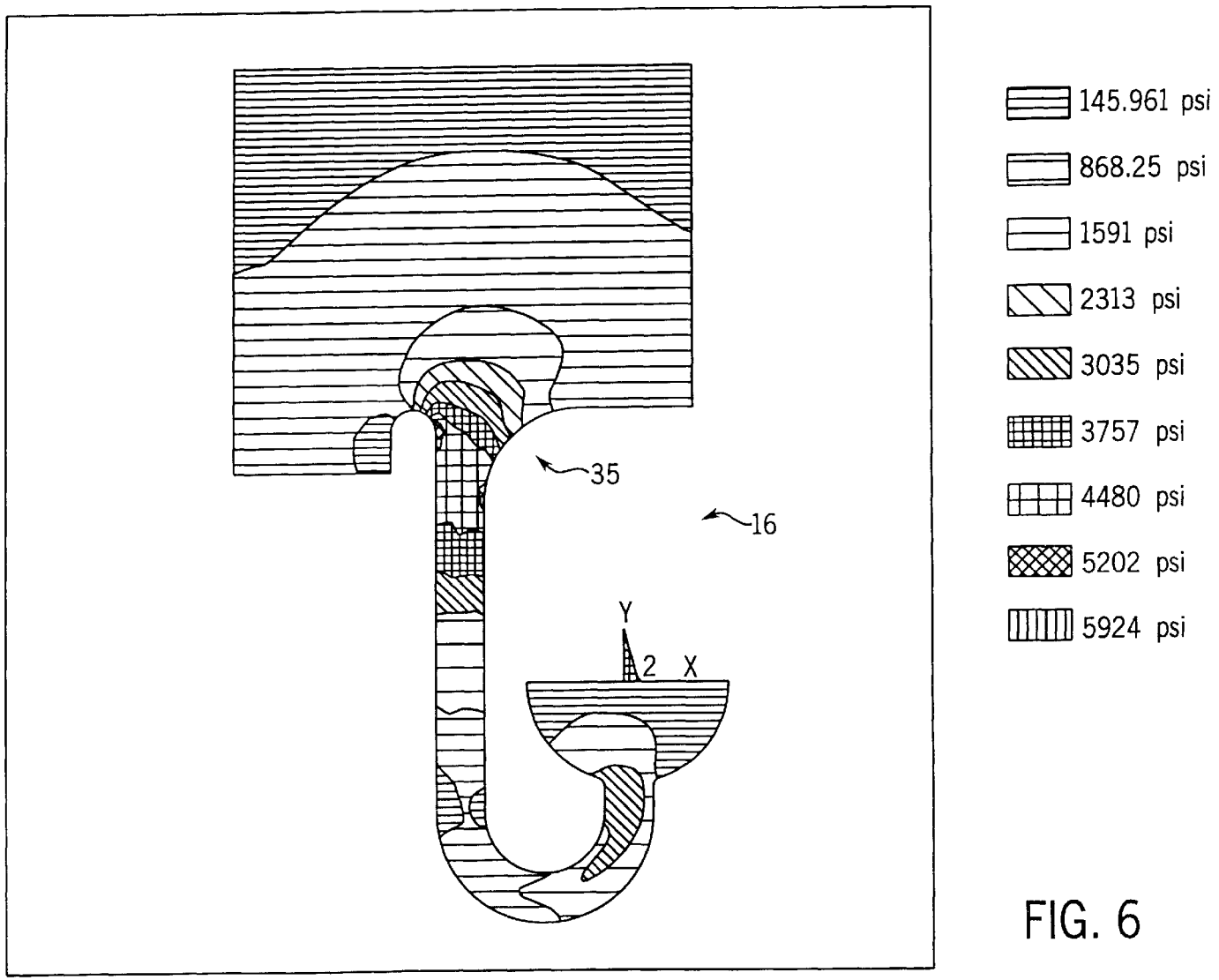
FIG. 6 is a plan view contour plot of a half finite element model of FIG. 5 showing isostress lines.
Figure 7:
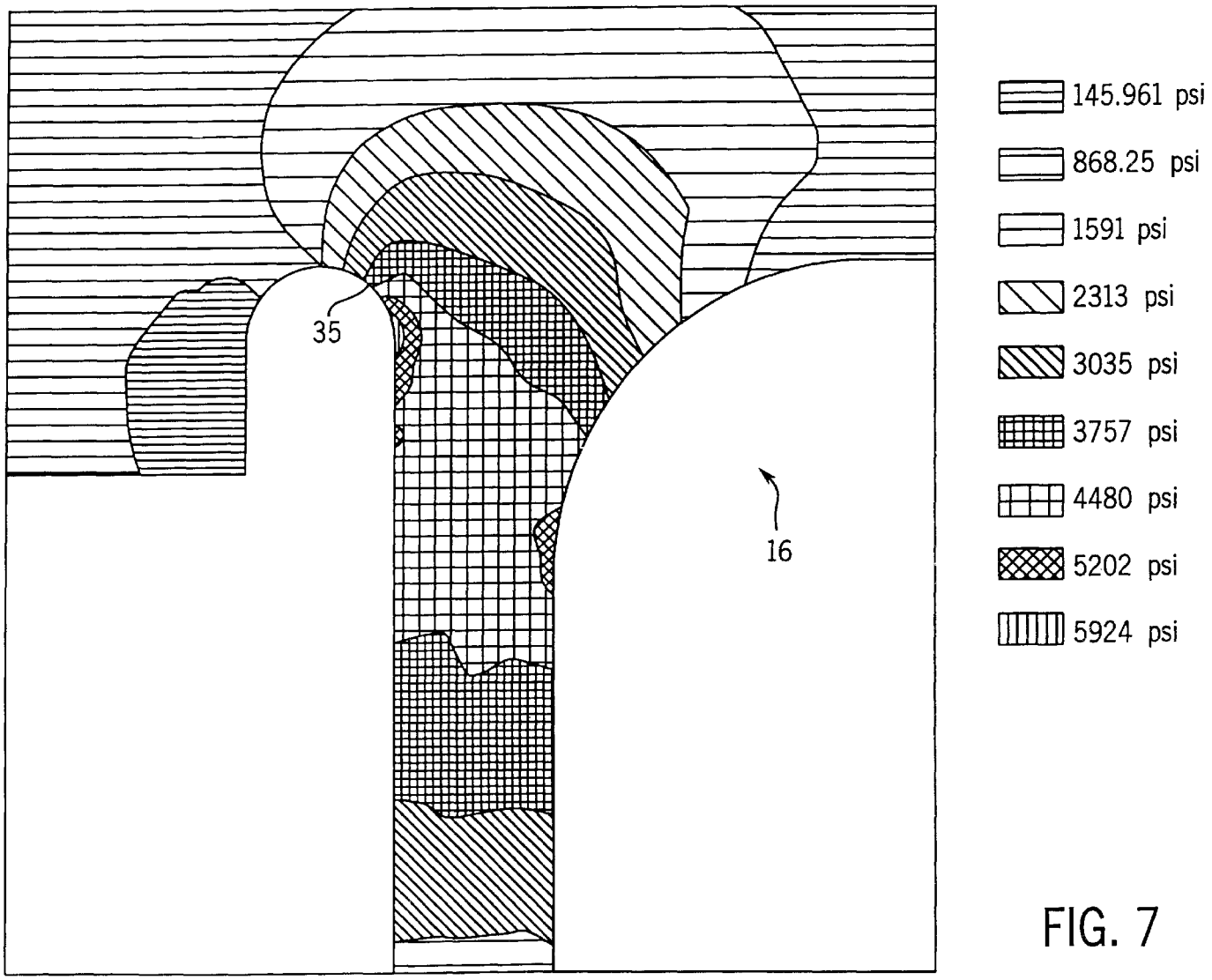
FIG. 7 is a magnified plan view contour plot of FIG. 6.
Figure 9:
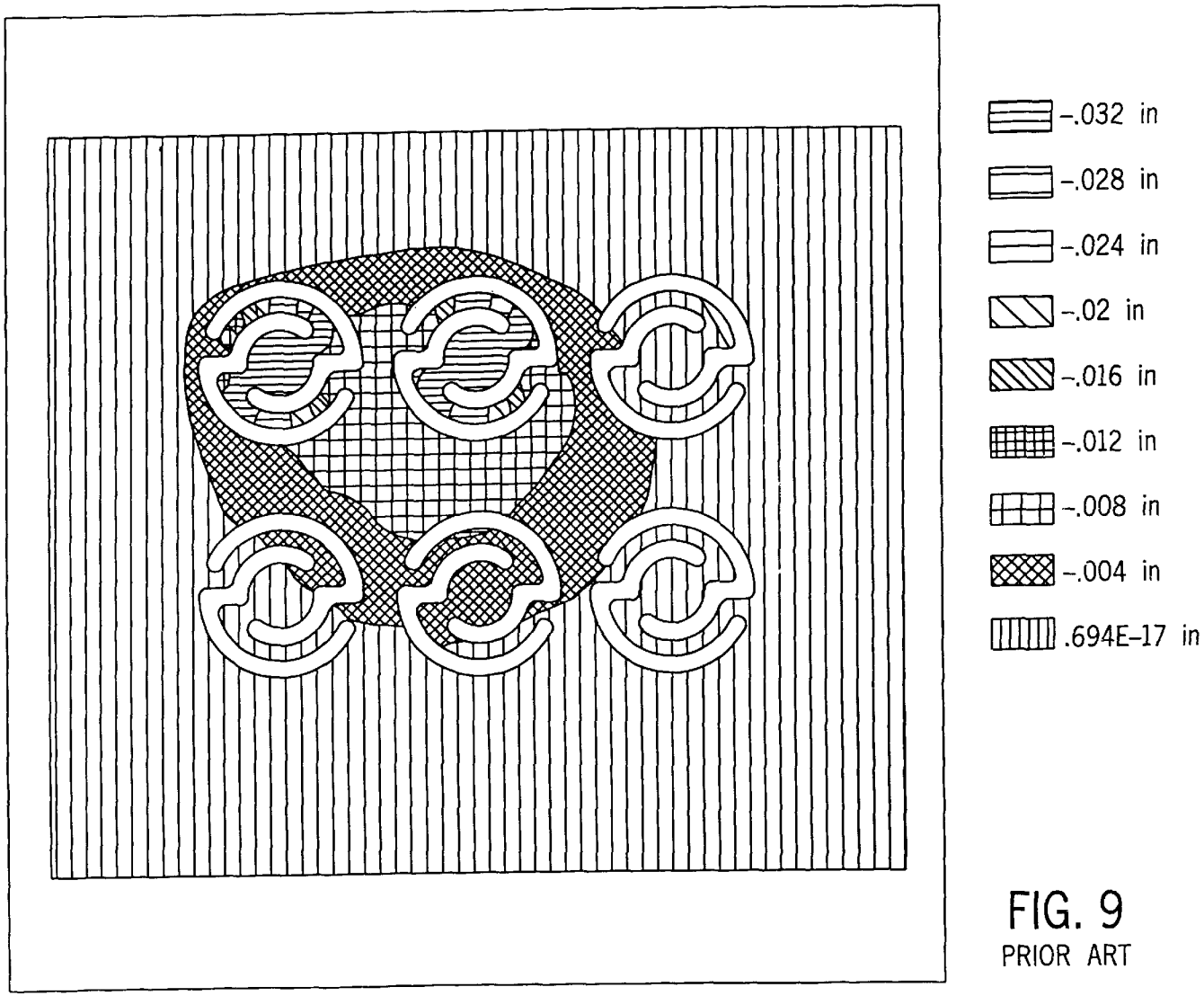
FIG. 9 PRIOR ART
FIG. 9 is a plan view contour plot of a finite element model of a prior art housing showing face plate and adjacent spring displacement that accompany displacement of one spring of the prior art housing.

A stress analysis, using a finite element model of the invention, distinguishes the invention from the prior art. As shown in FIG. 6, the stress analysis performed on the present invention modeled one half of the spring, taking advantage of symmetric geometry. Material properties for plastic, specifically Valox 310SEO available from GE Plastics, Pittsfield, Mass., were used in the analysis. The stresses on the spring were determined for a 0.035" axial displacement of the spring finger target. As shown in FIGS. 6 and 7, the extensions experience a maximum stress of less than 5932 psi at the base 35 of the spring 16. A prior art spring, such as shown in FIG. 9 typically incurs a maximum stress of 13,700 psi. This level of maximum stress is significant for commercial use because maximum stress levels that exceed 7200 psi typically indicate that the spring will fail in less than 1 million cycles.

Figure 8:
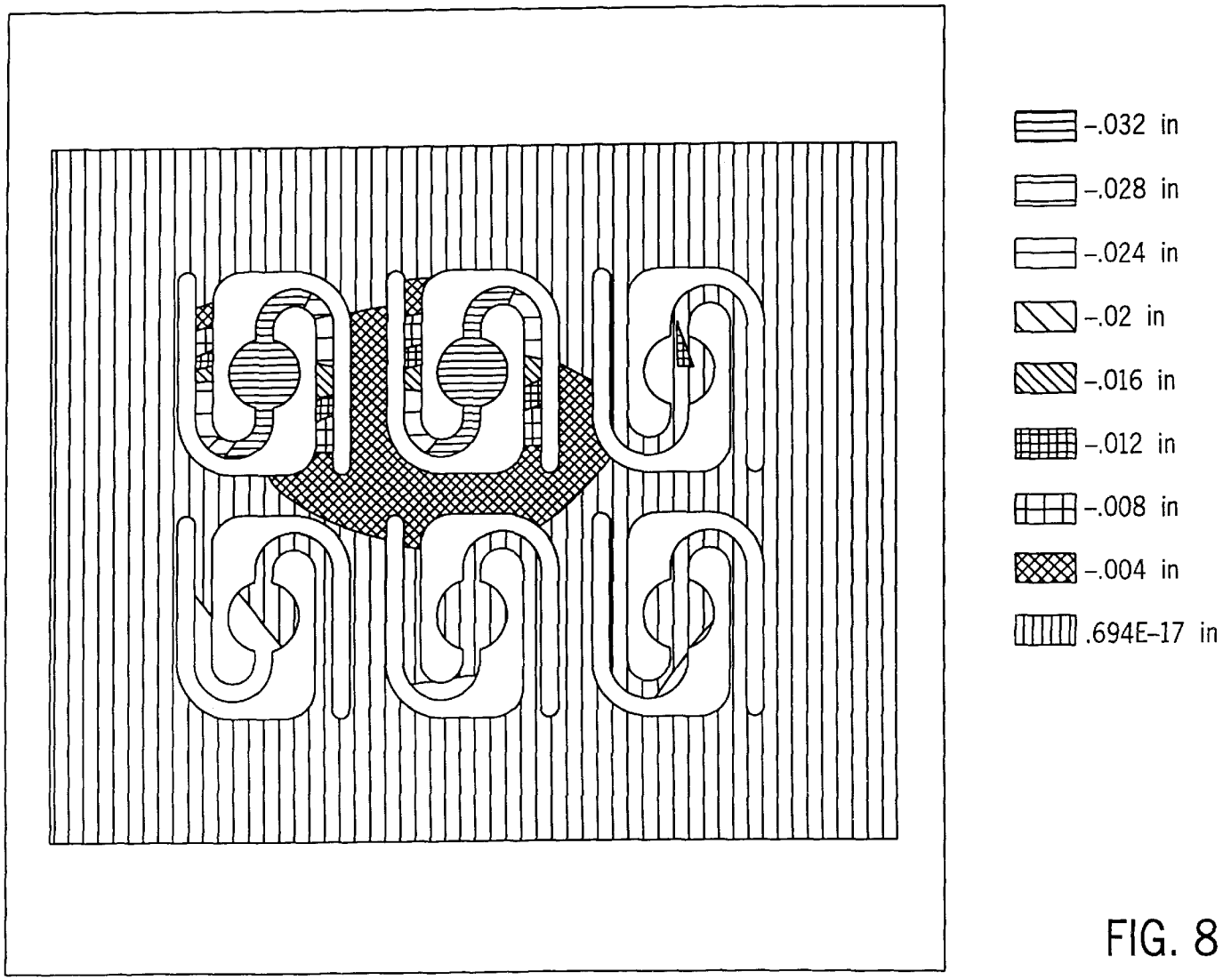
FIG. 8 is a plan view contour plot of a finite element model of FIG. 4 showing face plate and adjacent spring displacement that accompany displacement of one spring of the housing of FIG. 4.

Similarly, a finite element model of the invention is used to determine the displacement of material surrounding the spring to determine whether adjacent operators will be unintentionally activated by a single push-button. The plot in FIG. 9 of a prior art spring shows that when the prior art spring is depressed, adjacent springs, as well as the face plate in which they are molded, are also depressed. In contrast, the plot in FIG. 8 of the present invention, shows a significantly reduced deflection of areas adjacent to the spring for the same spring deflection.

For a spring and face plate as described herein having a nominal thickness of 0.055 inches, the finite element analysis calculated the force required to depress the spring 0.35 inches is approximately 0.9 lbs, indicating a spring constant of 25.7 lb/in. The peak stress, depression force, and spring constant will obviously differ for a spring and housing having dimensions and material characteristics that vary from the embodiment described herein. For example. in a preferred embodiment that has an extension width increased to 0.059" and a thickness of 0.065", a spring having material properties of Valox 357, also available from GE Plastics, will exhibit a peak stress of 4400 psi at the base of the spring with a force of 0.8 lbs required for a 0.035 displacement.

While there has been shown and described what are at present considered the preferred embodiment of the invention, it will be obvious to those skilled in the art that various changes and modifications can be made therein without departing from the scope of the invention defined by the appended claims. For example, the embodiment described herein can be scaled larger or smaller than the disclosed dimensions.

I claim:

1. A push button spring for use with a printed circuit board mounted push-button operator, said spring comprising:

a face plate having at least one aperture, said aperture having a pair of opposing sides joined by a pair of opposing end walls, wherein said sides have a greater length than the end walls;

a finger target centrally disposed in said aperture; and a pair of J shaped extensions integrally formed with said finger target and said face plate, each of said extensions have a first leg, and a second leg enjoined by a curved portion, each of said first legs extending radially in opposition from said finger target toward opposite end walls of said aperture, each of said second legs of said extensions extend into opposite end walls of said aperture which are substantially perpendicular to said second legs.

2. The spring as claimed in claim 1 wherein said face plate, finger target, and extensions are a thermoplastic polymer.

3. The spring as claimed in claim 1 wherein said finger target is cylindrical.

4. The spring as claimed in claim 1 wherein said first leg and said second leg are parallel.

5. The spring as claimed in claim 1 wherein said first leg and said second leg are straight.

6. The spring as claimed in claim 1 wherein said first leg and said second leg are different lengths.

7. The spring as claimed in claim 1 wherein said J-shaped extensions are of uniform width.

8. A housing for a plurality of closely spaced printed circuit board mounted operators comprising:

a base having a faceplate;

a plurality of apertures formed in said faceplate each of said apertures having a pair of opposing sides joined by opposing end walls substantially perpendicular to said sides, wherein said sides have a greater length than the end walls, and a longitudinal axis which extends through said end walls; and a plurality of springs, each of said springs being disposed in one of said apertures, and having a finger target supported by a pair of J-shaped extensions that are an integral part of said faceplate, wherein each of said J-shaped extensions have a first leg and a second leg, such that each of said first legs opposingly extend radially from said finger target along said longitudinal axis of said aperture toward opposite end walls of said aperture, and each of said second legs of said extensions extend into opposite end walls of said aperture which are substantially perpendicular to said second legs.

9. A housing as claimed in claim 8, wherein said apertures are no greater than 0.46 inches long along said longitudinal axis, and no greater than 0.40 inches wide along a transverse axis extending through said aperture sides.

10. A housing as claimed in claim 8, wherein centers of adjacent apertures are no greater than 0.55 inches apart in the longitudinal direction, and no greater than 0.47 inches apart in the transverse direction.

11. The housing as claimed in claim 8 wherein said faceplate, finger target, and extensions are a thermoplastic polymer.

12. The housing as claimed in claim 8 wherein said first leg and said second leg are parallel.

13. The housing as claimed in claim 8 wherein said first leg and said second leg are straight.

14. The housing as claimed in claim 8 wherein said first leg and said second leg are different lengths.

15. The housing as claimed in claim 8 wherein said J-shaped extensions are of uniform width.

* * * * *